US006971292B2

(12) United States Patent
Hu

(10) Patent No.: US 6,971,292 B2
(45) Date of Patent: Dec. 6, 2005

(54) FASTENER-DRIVING TOOL ASSEMBLY

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 10/693,746

(22) Filed: Oct. 23, 2003

(65) Prior Publication Data

US 2004/0083861 A1 May 6, 2004

(30) Foreign Application Priority Data

Oct. 25, 2002 (TW) ..... 91125403 A

(51) Int. Cl.[7] ..... B25B 23/16
(52) U.S. Cl. ..... 81/177.8; 81/177.85; 81/177.2
(58) Field of Search ..... 81/177.8, 177.9, 81/177.85, 177.2, 119

(56) References Cited

U.S. PATENT DOCUMENTS 4,711,145 A * 12/1987 Inoue ..... 81/177.1
4,774,862 A * 10/1988 Scull ..... 81/119
5,582,083 A * 12/1996 Baker ..... 81/119
5,797,300 A * 8/1998 Fairbanks ..... 81/60
6,038,946 A * 3/2000 Jackson et al. ..... 81/177.2
6,112,625 A * 9/2000 Turtle ..... 81/177.2
6,295,898 B1 * 10/2001 Hsieh ..... 81/177.8
6,324,947 B2 * 12/2001 Jarvis ..... 81/177.2
6,382,058 B1 * 5/2002 Owoc ..... 81/177.9
6,805,029 B1 * 10/2004 Foster et al. ..... 81/186

* cited by examiner

*Primary Examiner*—Jacob K. Ackun, Jr.
(74) *Attorney, Agent, or Firm*—Alan D. Kamrath; Nikolai & Mersereau, P.A.

(57) ABSTRACT

A fastener-driving tool assembly includes a fastener-driving member and a coupling device. The fastener-driving member includes a first end and a second end for driving a fastener. The first end of the fastener-driving member includes a polygonal opening. The coupling device includes a first member and a second member. The second member has a polygonal end securely engaged with the polygonal opening of the fastener-driving member. The first member includes an end for engaging with the other end of the second member. The other end of the first member includes a polygonal engaging hole for engaging with one of an extension rod, a handle, and a polygonal first end of a second member of a similarly constructed coupling device.

8 Claims, 12 Drawing Sheets

FASTENER-DRIVING TOOL ASSEMBLY

BACKGROUND OF THE INVENTION

1. Field of the Invention

The present invention relates to a fastener-driving tool assembly for tightening/loosening fasteners.

2. Description of the Related Art

Taiwan Utility Model Publication No. 256142 discloses a hand tool including a handle having a first drive member integrally formed on an end thereof. A pivotal portion is formed on the other end of the handle. A pivotal drive device is pivotally mounted to the pivotal portion, with a second drive member being formed on an end of the pivotal drive device and with a third drive member being formed on the other end of the pivotal drive device. The first, second, and third drive members are of different sizes for selectively driving sockets of different sizes. However, the hand tool cannot be directly used to drive fasteners. Further, the handle of the hand tool is relatively long and thus could not be used in a limited space.

SUMMARY OF THE INVENTION

An object of the present invention is to provide a fastener-driving tool assembly that can be used in a limited space.

Another object of the present invention is to provide a fastener-driving tool assembly that can be directly used to drive fasteners.

In accordance with one aspect of the invention, the fastener-driving tool assembly includes a fastener-driving member and a coupling device. The fastener-driving member includes a first end and a second end for driving a fastener. The first end of the fastener-driving member includes a polygonal opening. The coupling device includes a first member and a second member. The second member has a polygonal first end securely engaged with the polygonal opening of the fastener-driving member and a second end. The first member includes a first end for engaging with the second end of the second member and a second end. The second end of the first member includes a polygonal engaging hole for engaging with one of an extension rod, a handle, and a polygonal first end of a second member of a similarly constructed coupling device.

In an embodiment of the invention, means are provided for pivotally connecting the second end of the first member and the second end of the second member and for retaining the second end of the first member in a desired angular position relative to the second end of the second member. The second end of the fastener-driving member includes a pair of spaced jaws or a box end. The first member has a length that is smaller than four times of a width of the first member. Preferably, the polygonal opening of the fastener-driving member, the polygonal engaging hole of the first member, and the polygonal first end of the second member are square.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
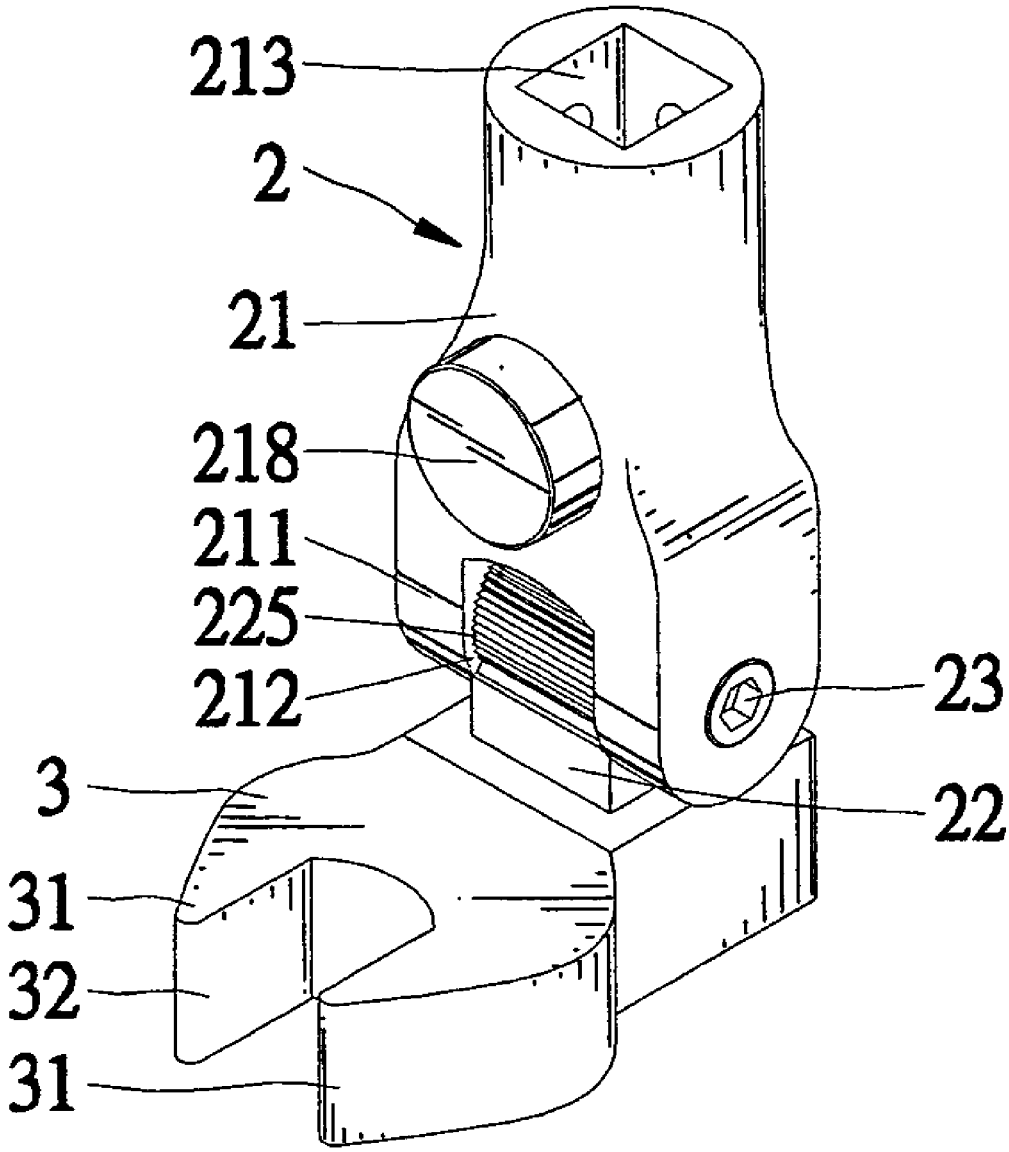
FIG. 1 is a perspective view of a fastener-driving tool assembly in accordance with the present invention.
Figure 2:
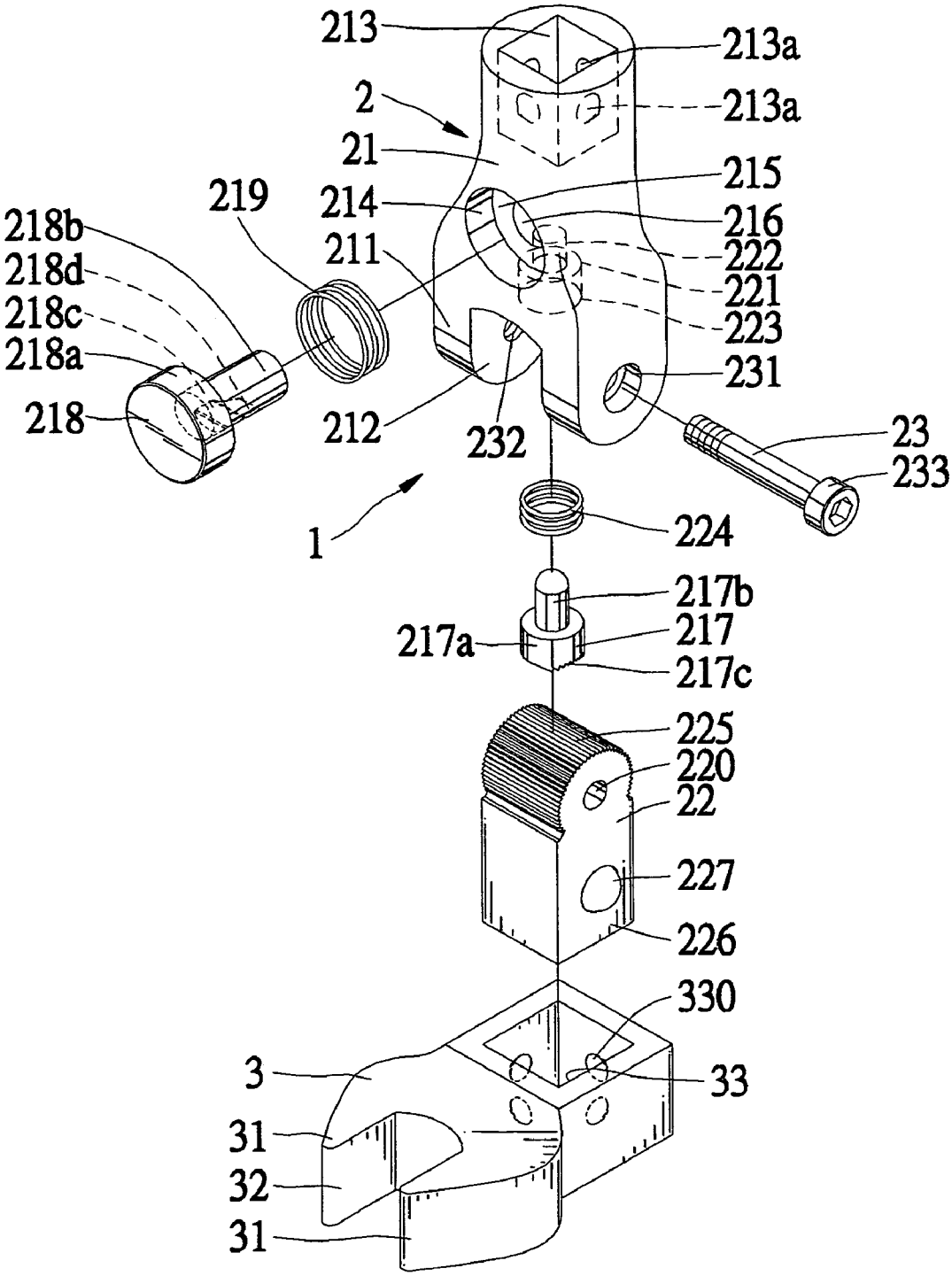
FIG. 2 is an exploded perspective view of the fastener-driving tool assembly in accordance with the present invention.
Figure 3:
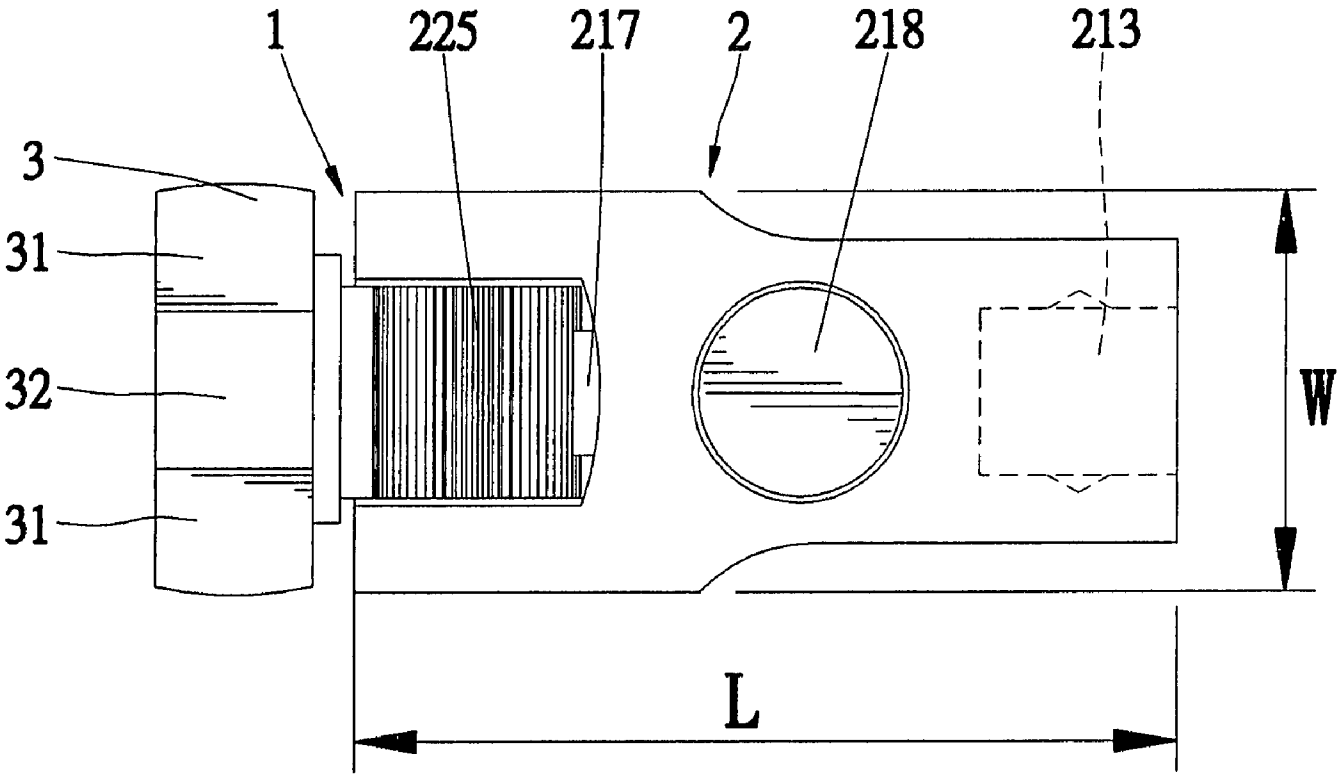
FIG. 3 is a top view of the fastener-driving tool assembly in accordance with the present invention.
Figure 4:
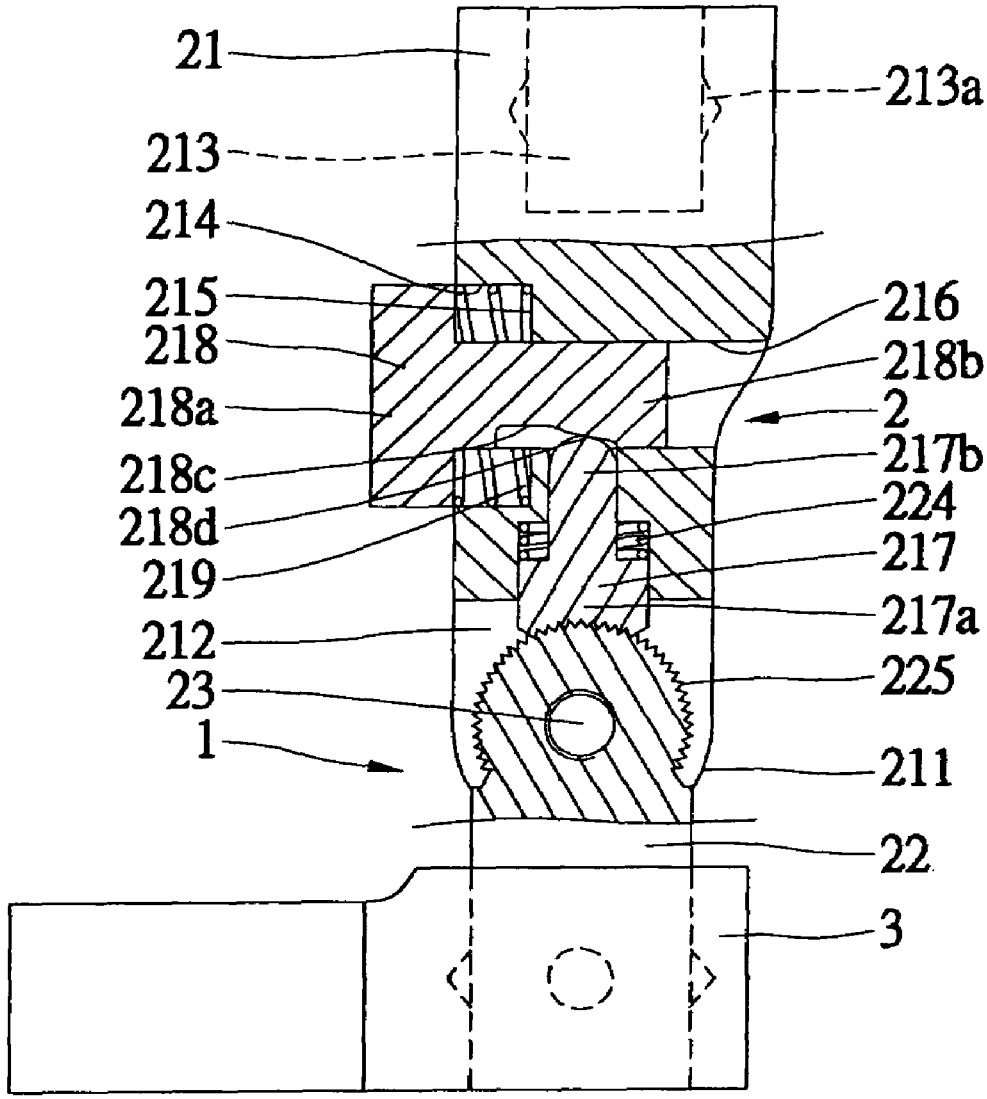
FIG. 4 is a side view, partly sectioned, of the fastener-driving tool assembly in accordance with the present invention.

Referring to FIGS. 1, 2, and 4, a fastener-driving tool assembly in accordance with the present invention generally comprises a coupling device 2 and a fastener-driving member 3 releasably mounted to the coupling device 2. As illustrated in FIG. 2, the fastener-driving member 3 includes an opening 33 in a first end thereof and a pair of jaws 31 on a second end thereof. The opening 33 of the fastener-driving member 3 is polygonal, preferably square. A cavity 330 is defined in each of four sidewalls delimiting the opening 33 of the fastener-driving member 3. An opening or space 32 is defined between the jaws 31 for receiving and thus driving a fastener such as a nut, bolt head, etc.

Still referring to FIG. 2, the coupling device 2 includes a first member 21 and a second member 22 that has a first end 226 releasably engaged in the opening 33 of the fastener-driving member 3. In this embodiment, a spring-biased ball 227 is mounted in the first end 226 of the second member 22 for coupling with one of the cavities 330 of the fastener-driving member 3. The second member 22 further includes a plurality of teeth 225 on a second end thereof. Preferably, the second end of the second member 22 is arcuate, with the teeth 225 being formed on a periphery of the second end of the second member 22 and with a pin hole 220 extending through the second end of the second member 22.

The first member 21 includes a pair of jugs 211 on a first end thereof and a polygonal (preferably square) engaging hole 213 in a second end thereof. At least one of four sidewalls delimiting the square engaging hole 213 has a cavity 213*a* defined therein. The lugs 211 include aligned screw holes 232 one of which has a countersink 231. A space 212 is defined between the lugs 211. A receptacle 221 is defined in a bottom wall delimiting the space 212 and includes a first section 222 distal to the lugs 211 and a second section 223 proximal to the lugs 211. Preferably, the first section 222 has a diameter smaller than that of the second section 223.

Referring to FIGS. 2 and 4, an elastic element 224 and an actuating member 217 are received in the second section 223 of the receptacle 221. The actuating member 217 includes a first end 217*a* received in the second section 223 of the receptacle 221 and a second end 217*b* received in the first section 222 of the receptacle 221. The first end 217*a* of the actuating member 217 includes a toothed portion 217*c*.

The first member 21 further includes a hole 214 in a side thereof, with a bore 216 being defined in a bottom wall 215 delimiting the hole 214 and communicated with the first section 222 of the receptacle 221. An elastic element 219 is mounted in the hole 214 of the first member 21. Further, a push button 218 includes an enlarged head 218*a* and a shank 218*b* extending from the enlarged head 218*a*. The enlarged head 218*a* is located outside the first member 21 for manual operation. The shank 218*b* extends through the hole 214 of the first member 21 into the bore 216 of the first member 21, with the elastic element 219 being mounted around the shank 218*b*, best shown in FIG. 4. The shank 218*b* of the push button 218 includes a first recessed portion 218*c* and a second recessed portion 218*d* in an outer periphery thereof. The second recessed portion 218*d* is preferably inclined and contiguous to the first recessed portion 218*c* that is deeper than the second recessed portion 218*d*. The second recessed portion 218*d* is biased by the elastic element 219 toward the second end 217*b* of the actuating member 217.

In assembly, a pin 23 is extended through the pin holes 232 of the lugs 211 of the first member 21 and the pin hole 220 of the second member 22, with a head 233 of the pin 23 being received in the countersink 231 of the first member 21. Preferably, the first member 21 has a length L smaller than four times of a width W of the first member 21 (i.e., L <4W). Thus, the first member 21 can be used in a limited space.

The fastener-driving member 3 in FIG. 4 is retained in an angular position relative to the coupling device 2. It is noted that the second recessed portion 218*d* presses against the second end 217*b* of the actuating member 217 under the action of the elastic element 219, thereby urging and the toothed portion 217*c* of the actuating member 217 to engage with the teeth 225 of the second member 22.

Figure 4A:
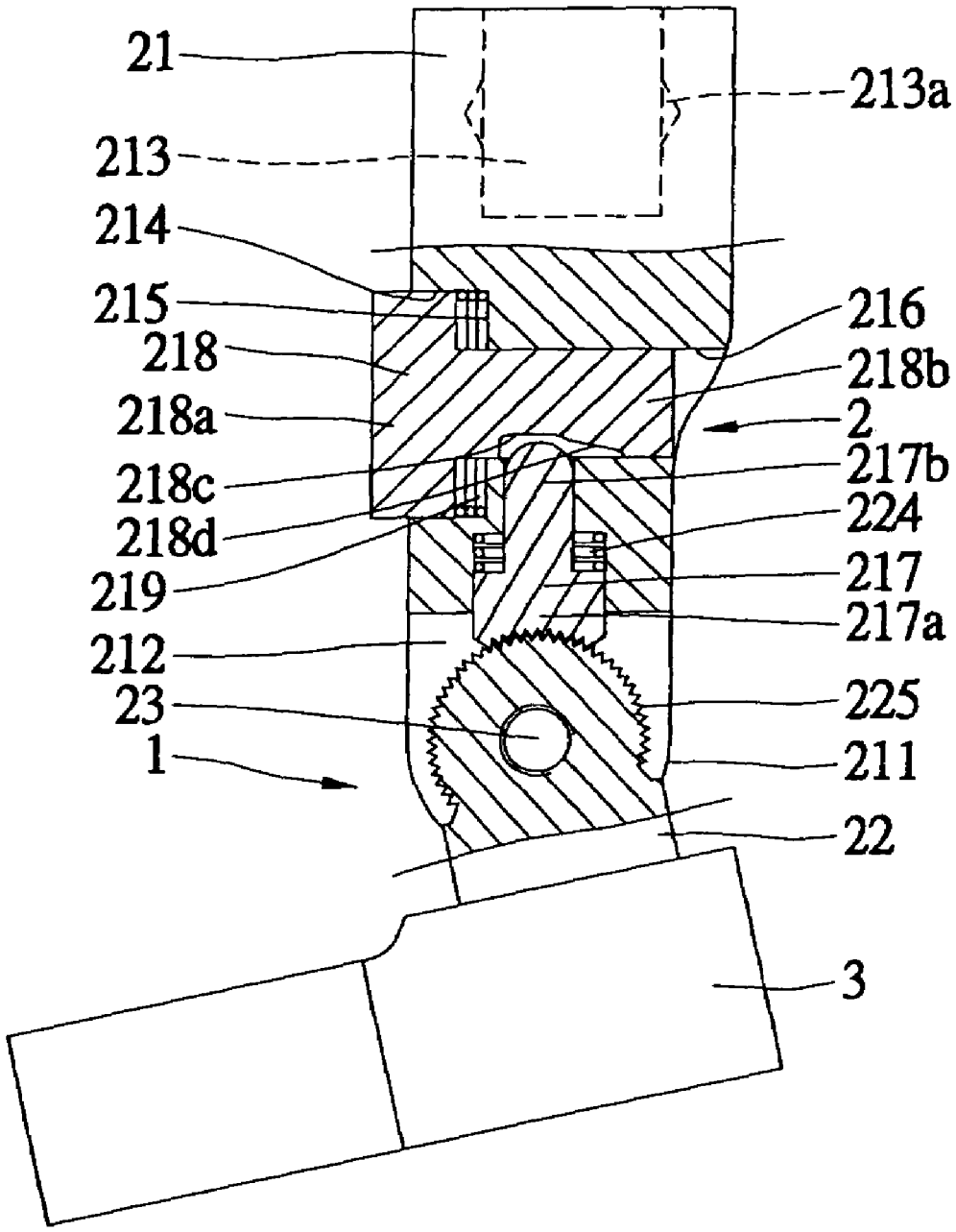
FIG. 4A is a view similar to FIG. 4, wherein a push button is pressed for adjusting an angular position of a fastener-driving member relative to a coupling device of the fastener-driving tool assembly in accordance with the present invention.

When adjustment of the angular position of the fastener-driving member 3 relative to the coupling device 2 is required, the enlarged end 218*a* of the push button 218 is pushed, which causes sliding movement of the shank 218*b* in the hole 214 and the bore 216 of the first member 21. As illustrated in FIG. 4A, the second end 217*b* of the actuating member 217 is disengaged from the second recessed portion 218*d* of the shank 218*b* of the push button 218 to a position aligned with the first recessed portion 218*c* that is deeper than the second recessed portion 218*d*, allowing the second member 22 and the fastener-driving member 3 to pivot relative to the first member 21. The push button 218 is released when the fastener-driving member 3 reaches the desired angular position relative to the first member 21, and the fastener-driving member 3 is again retained in place.

Figure 5:
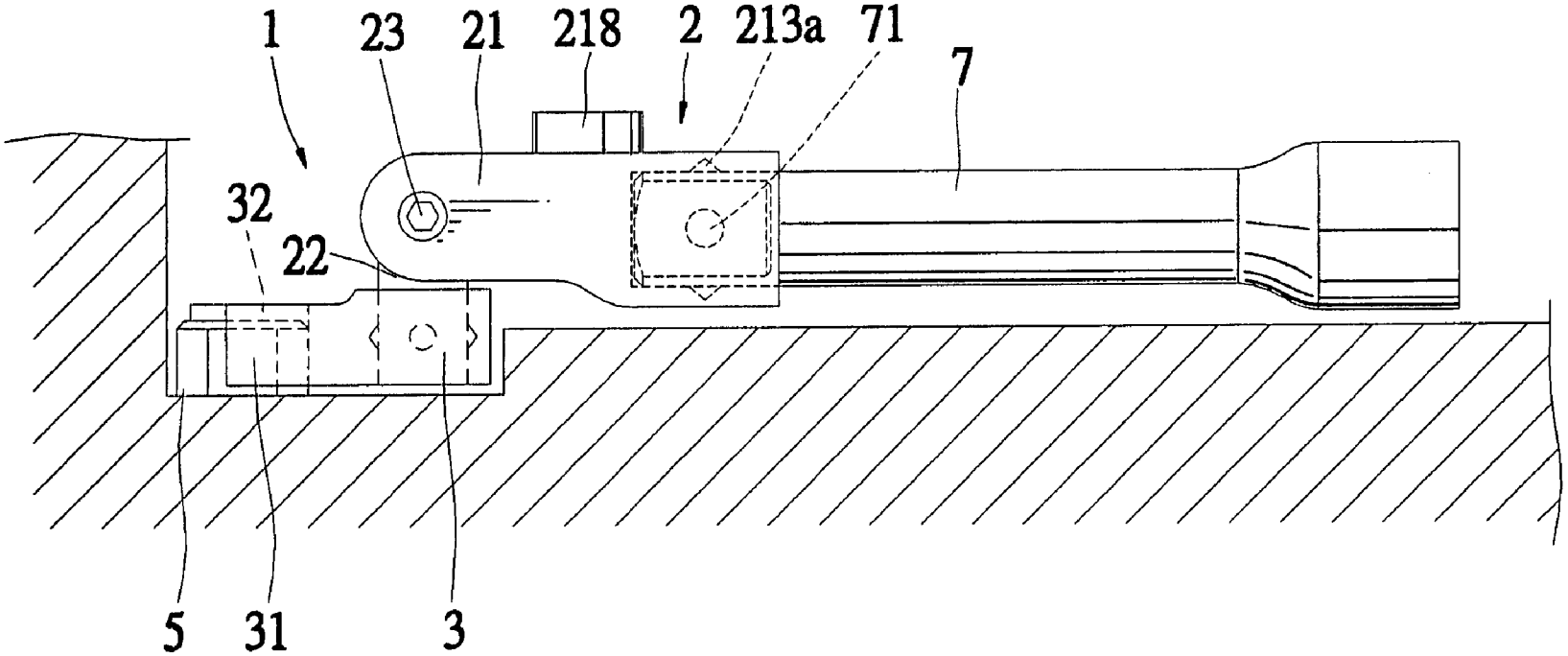
FIG. 5 is a schematic side view illustrating operation of the fastener-driving tool assembly in accordance with the present invention in a limited space.

FIG. 5 illustrates the operation of the fastener-driving tool assembly in accordance with the present invention in a limited space. The jaws 31 of the first member 3 are engaged with a fastener 5. A handle or extension rod 7 has an end releasably coupled in the polygonal engaging hole 213 of the first member 21, and the user may grip the other end of the extension rod 7 for tightening/loosening a fastener 5 located in a difficult-to-operate position. The end of the extension rod 7 may include a spring-biased ball 71 mounted therein, with the spring-biased ball 71 being releasably engaged in one of the cavities 213*a* of the first member 21.

Figure 6:
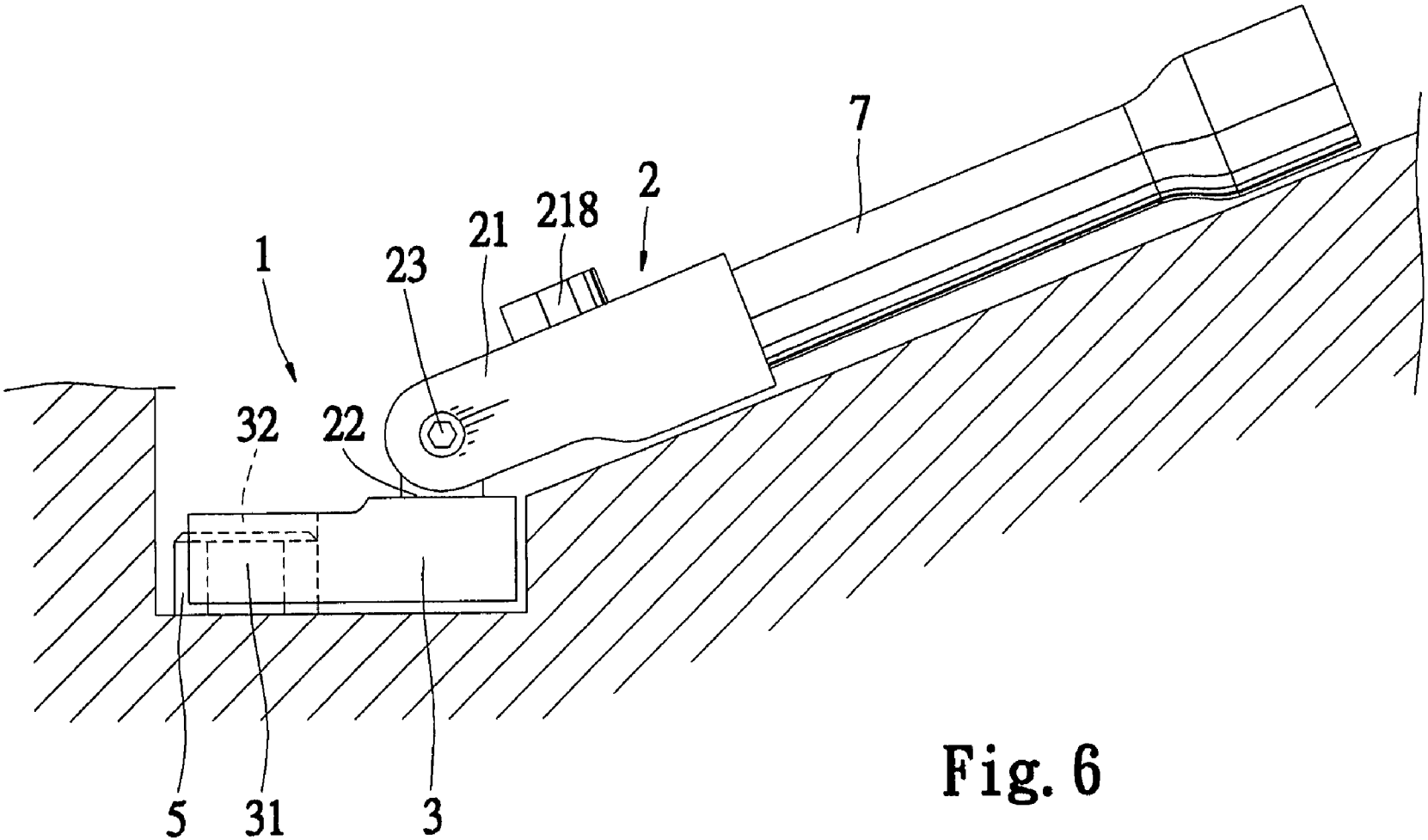
FIG. 6 is a schematic side view illustrating operation of the fastener-driving tool assembly in accordance with the present invention in another limited space.

FIG. 6 is a schematic side view illustrating operation of the fastener-driving tool assembly in accordance with the present invention in another limited space. As mentioned above, the fastener-driving member 3 and the second member 22 can be adjusted to a desired angular position of relative to the first member 21. Again, the jaws 31 of the first member 3 are engaged with a fastener 5. A handle or extension rod 7 has an end releasably coupled in the polygonal engaging hole 213 of the first member 21, and the user may grip the other end of the extension rod 7 for tightening/loosening a fastener 5 located in a difficult-to-operate position.

Figure 7:
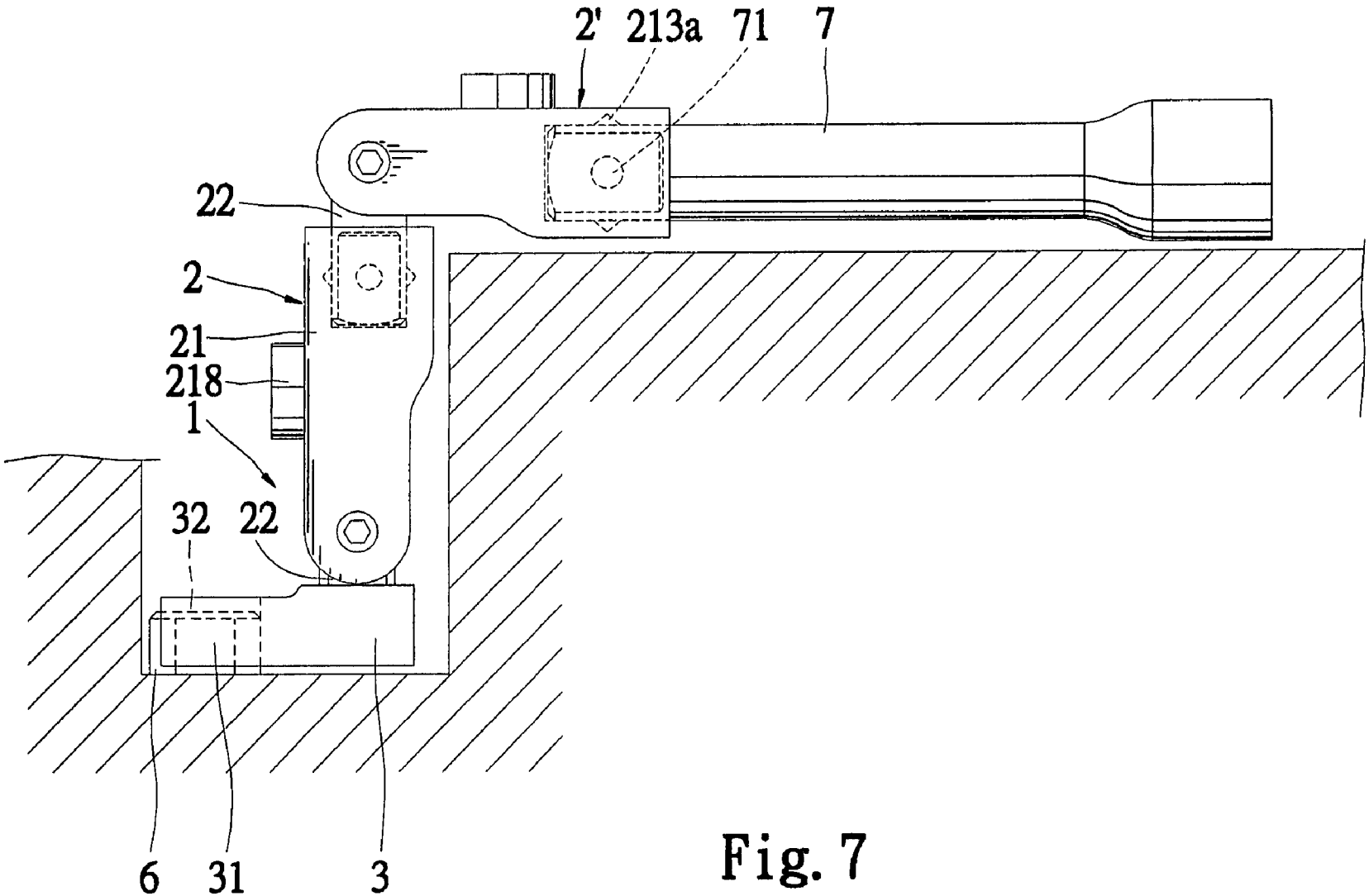
FIG. 7 is a schematic view illustrating of the fastener-driving tool assembly in accordance with the present invention in a further limited space.

FIG. 7 is a schematic view illustrating of the fastener-driving tool assembly in accordance with the present invention in a further limited space. An additional coupling device 2' can be provided in a case for driving a fastener 6 located in a limited space having a relatively large depth. The jaws 31 of the fastening-driving member 3 of the coupling device 2 are engaged with the fastener 6. The second member 22 of the additional coupling device 2' is coupled in the polygonal engaging hole 213 of the coupling device 2. A handle or extension rod 7 has an end releasably coupled in the polygonal engaging hole 213 of the first member 21 of the additional coupling device 2', and the user may grip the other end of the extension rod 7 for tightening/loosening the fastener 6 located in a difficult-to-operate position.

Figure 8:
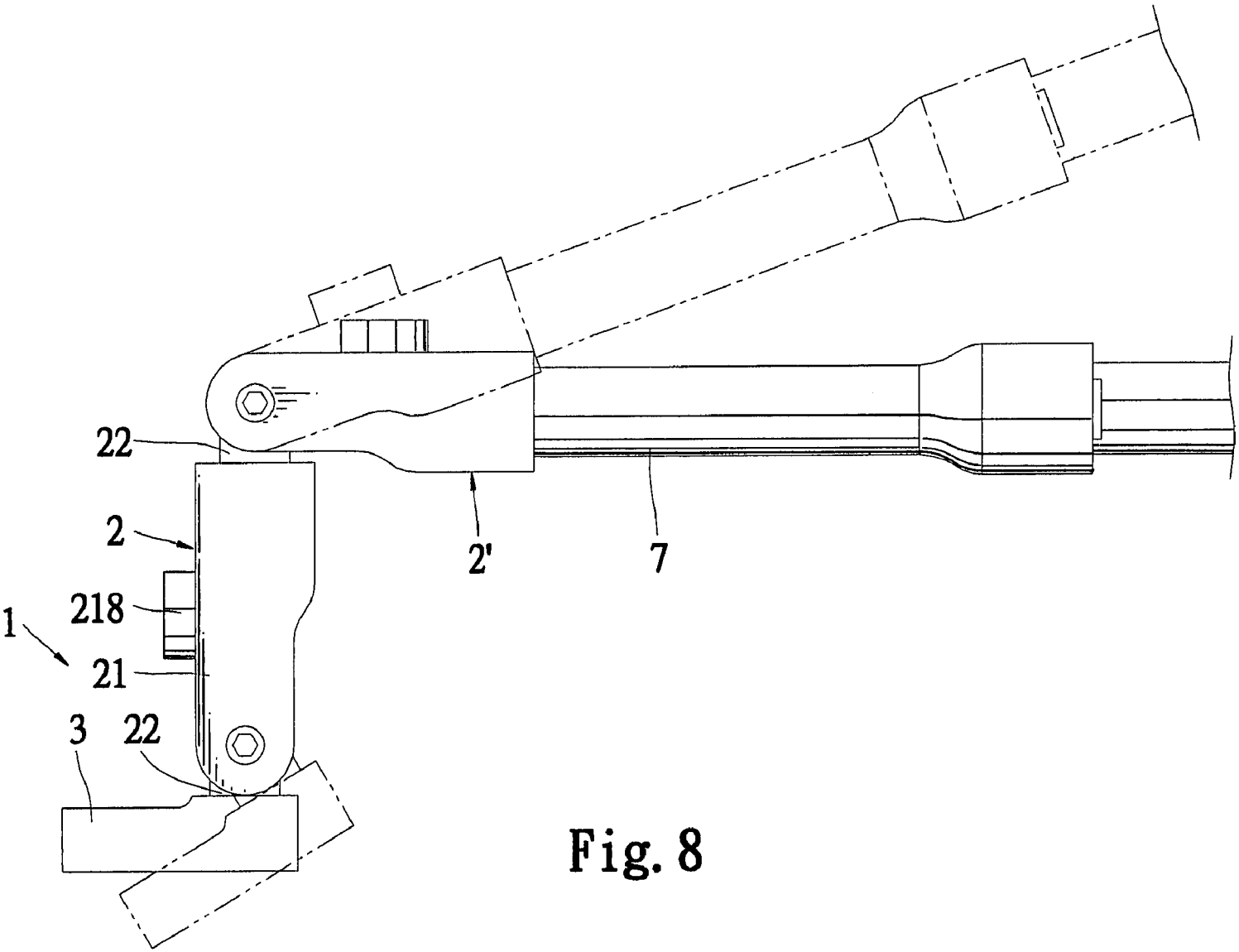
FIG. 8 is a schematic side view illustrating adjusting of the fastener-driving tool assembly in FIG. 7.

FIG. 8 is a schematic side view illustrating adjusting of the fastener-driving tool assembly in FIG. 7. The angular position of the fastener-driving member 3 and the second member 22 of the coupling device 2 can be adjusted relative to the first member 21 of the coupling device 2, and the angular position of the handle or extension rod 7 and the first member 21 of the additional coupling device 2' can be adjusted relative to the second member 22 of the additional coupling device 2'.

Figure 9:
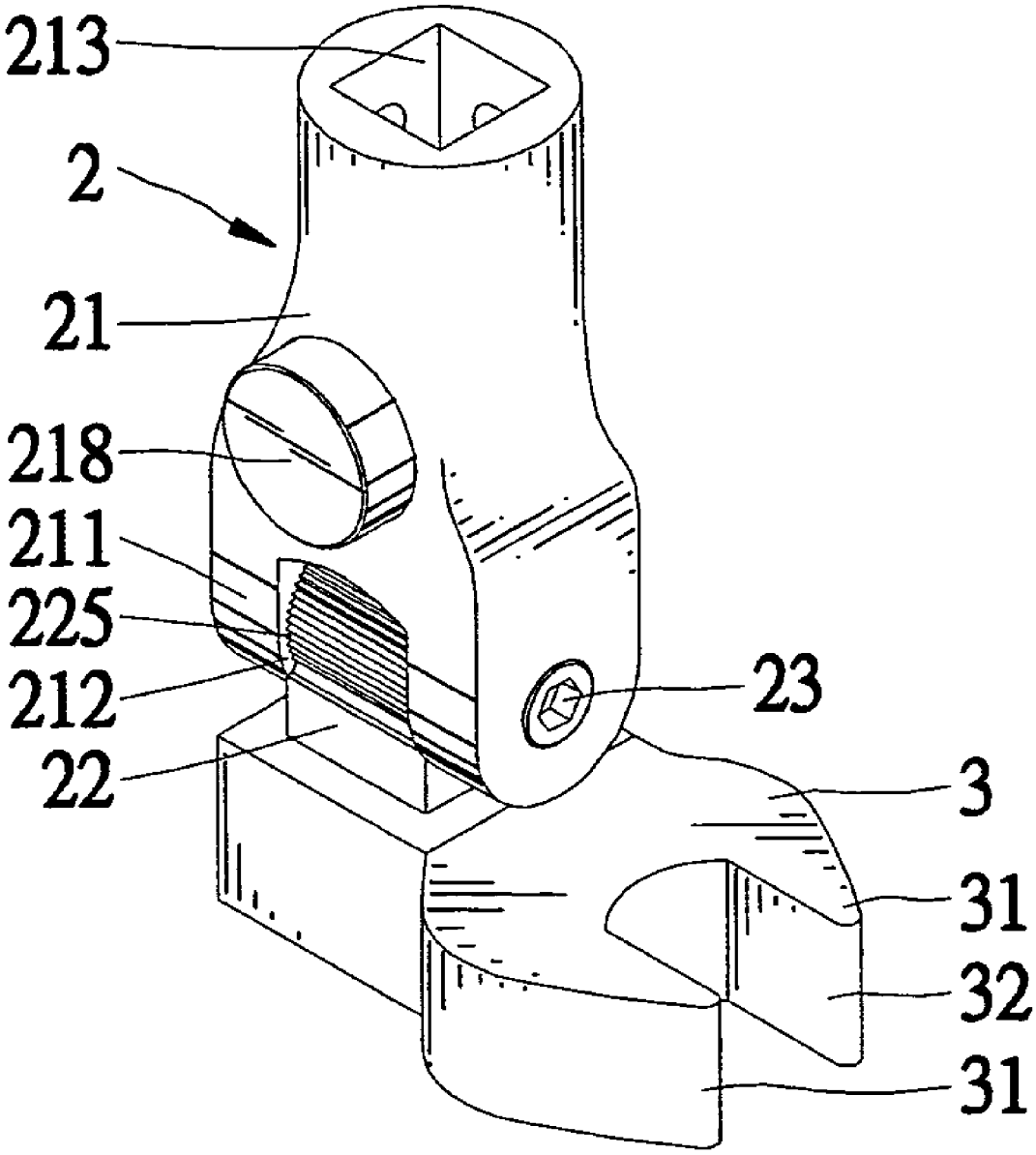
FIG. 9 is a perspective view of the fastener-driving tool assembly in accordance with the present invention, wherein the fastener-driving member is pivoted through 90 degrees.
Figure 10:
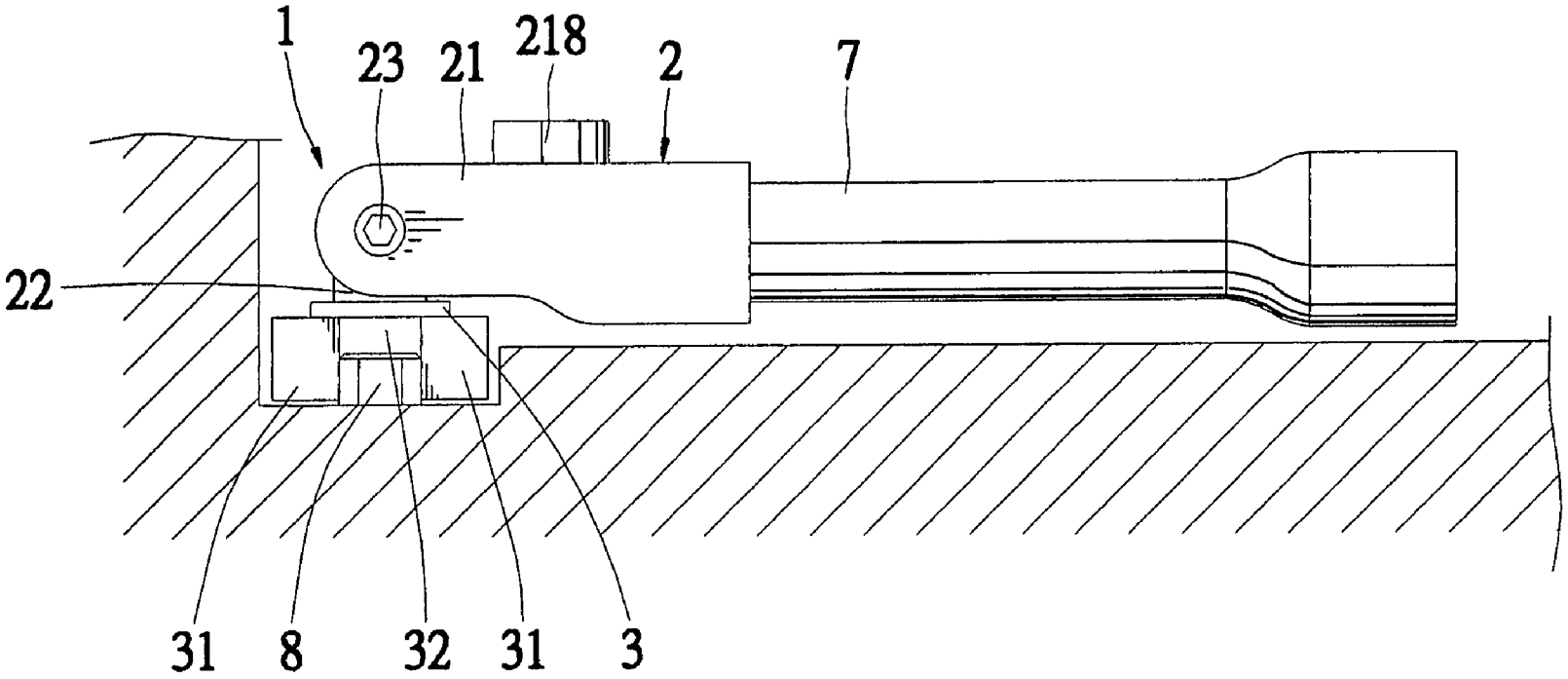
FIG. 10 is a schematic view illustrating operation of the fastener-driving tool assembly in FIG. 9.

FIG. 9 is a perspective view of fastener-driving tool assembly in accordance with the present invention, wherein the fastener-driving member 3 is pivoted through 90 degrees. FIG. 10 is a schematic view illustrating operation of the fastener-driving tool assembly in FIG. 9. A fastener 8 located in a difficult-to-drive position can be easily tightened/loosened by the fastener-driving tool assembly in accordance with the present invention.

Figure 11:
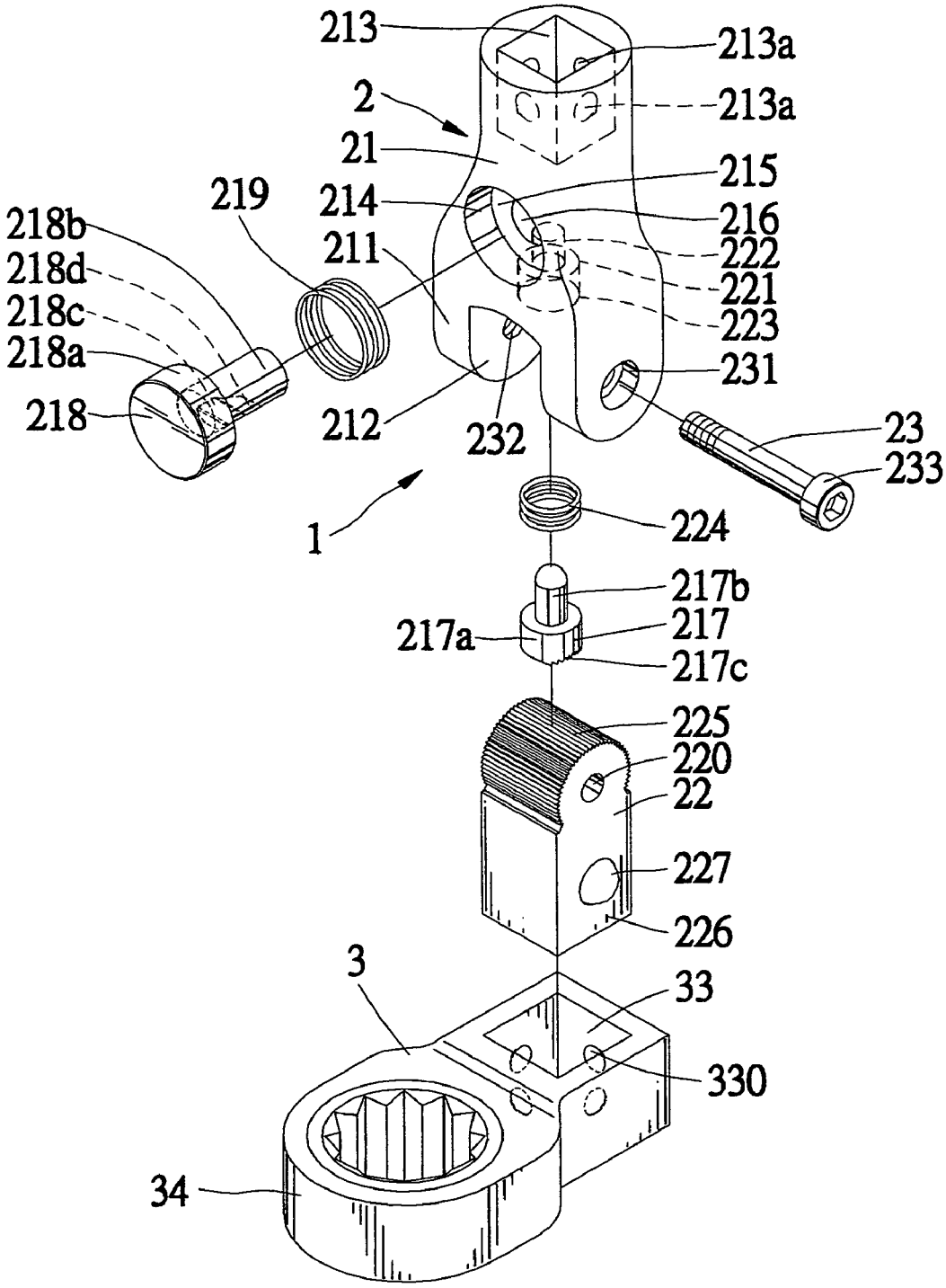
FIG. 11 is an exploded perspective view illustrating a modified embodiment of the fastener-driving tool assembly in accordance with the present invention.

It is noted that the jaws 31 of the fastener-driving member 3 can be replaced by any other suitable faster-driving element, such as a ring or box end 34 (FIG. 11) allowing or not allowing reversible ratcheting operations.

The fastener-driving tool assembly 1 in accordance with the present invention allows the user to operate the handle or extension rod 7 at a level different from that of the fastener 3.

Although the invention has been explained in relation to its preferred embodiment, it is to be understood that many other possible modifications and variations can be made without departing from the scope of the invention as hereinafter claimed.

What is claimed is:

1. A fastener-driving tool assembly comprising:

a fastener-driving member including a first end and a second end for driving a fastener, the first end of the fastener-driving member including a polygonal opening; and a coupling device including a first member and a second member, the second member having a polygonal first end securely engaged with the polygonal opening of the fastener-driving member and a second end, the first member including a first end for engaging with the second end of the second member and a second end, the second end of the first member including a polygonal engaging hole for engaging with one of an extension rod, a handle, and a polygonal first end of a second member of a similarly constructed coupling device, with the first end of the first member and the second end of the second member being pivotally connected, and with the first end of the first member being retained in a desired angular position relative to the second end of the second member, wherein the second end of the second member is arcuate and includes a plurality of teeth on a periphery thereof, with a pin hole extending through the second end of the second member, the first end of the first member defining a space for receiving the second end of the second member and allowing pivotal movement of the second end of the second member, a pin extending through the first end of the first member and the pin hole of the second member, wherein the first end of the first member includes a pair of lugs that define the space therebetween, wherein a receptacle is defined in a bottom wall delimiting the space and includes a first section distal to the lugs and a second section, the first section having a diameter smaller than that of the second section, an elastic element and an actuating member being received in the second section of the receptacle, the actuating member including a first end received in the second section of the receptacle and a second end received in the first section of the receptacle, the first end of the actuating member including a toothed portion engaged with the teeth of the second member under action of the elastic element.

2. The fastener-driving tool assembly as claimed in claim 1, wherein the second end of the fastener-driving member includes a pair of spaced jaws.

3. The fastener-driving tool assembly as claimed in claim 1, wherein the second end of the fastener-driving member is a box end.

4. The fastener-driving tool assembly as claimed in claim 1, wherein the first member has a length that is smaller than four times of a width of the first member.

5. The fastener-driving tool assembly as claimed in claim 1, wherein the polygonal opening of the fastener-driving member is square.

6. The fastener-driving tool assembly as claimed in claim 1, wherein the polygonal engaging hole of the first member is square.

7. The fastener-driving tool assembly as claimed in claim 1, wherein the polygonal first end of the second member is square.

8. The fastener-driving tool assembly as claimed in claim 1, wherein the first member further includes a hole in a side thereof, with a bore being defined in a bottom wall delimiting the hole and communicated with the first section of the receptacle, a second elastic element being mounted in the hole of the first member, a push button including an enlarged head and a shank extending from the enlarged head, the enlarged head is biased by the second elastic element to a position outside the first member for manual push, the shank extending through the hole of the first member into the bore of the first member, the shank including a first recessed portion and a second recessed portion in an outer periphery thereof, the first recessed portion being deeper than the second recessed portion, the second recessed portion being biased by the second elastic element toward the second end of the actuating member;

wherein when the push button is not pushed, the second end of the actuating member is engaged with the second recessed portion of the push button, the toothed portion of the actuating member is biased by the elastic element to engage with the teeth of the second member, thereby retaining the second member in place; and wherein when the push button is pushed, the second end of the actuating member is aligned with the first recessed portion of the push button that is deeper than the second recessed portion, allowing the second member and the fastener-driving member to pivot relative to the first member.

* * * * *